US005583551A

United States Patent [19]

Allred et al.

[11] Patent Number: 5,583,551

[45] Date of Patent: Dec. 10, 1996

[54] DEFLECTION ELECTRODE

[75] Inventors: Donald R. Allred, Westford, Mass.; Thomas A. Davis, Hollis, N.H.

[73] Assignee: Iris Graphics, Inc., Bedford, Mass.

[21] Appl. No.: 434,903

[22] Filed: May 1, 1995

Related U.S. Application Data

[63] Continuation of Ser. No. 134,521, Oct. 8, 1993, abandoned.

[51] Int. Cl.[6] ..... B41J 2/09

[52] U.S. Cl. ..... 347/77; 252/510; 252/511

[58] Field of Search ..... 252/510, 511; 347/77

[56] References Cited

U.S. PATENT DOCUMENTS

| | | | |
|---|---|---|---|
| 4,031,033 | 6/1977 | Budevski et al. | 252/511 |
| 4,307,407 | 12/1981 | Donahue et al. | 347/77 |
| 4,321,608 | 3/1982 | Kakeno | 347/77 |
| 4,356,500 | 10/1982 | Graf | 437/77 |
| 4,651,163 | 3/1987 | Sutera et al. | 347/77 |
| 4,658,269 | 4/1987 | Rezanka | 347/77 |
| 4,839,664 | 6/1989 | Archer et al. | 347/77 |
| 5,286,952 | 2/1994 | McMills et al. | 219/535 |

*Primary Examiner*—Valerie A. Lund
*Attorney, Agent, or Firm*—Ladas & Parry

[57] ABSTRACT

A deflection electrode for use in a continuous ink jet printing device molded of powdered ultra high molecular weight polyethylene combined with carbon black and subjected to oxygen plasma treatment.

15 Claims, 1 Drawing Sheet

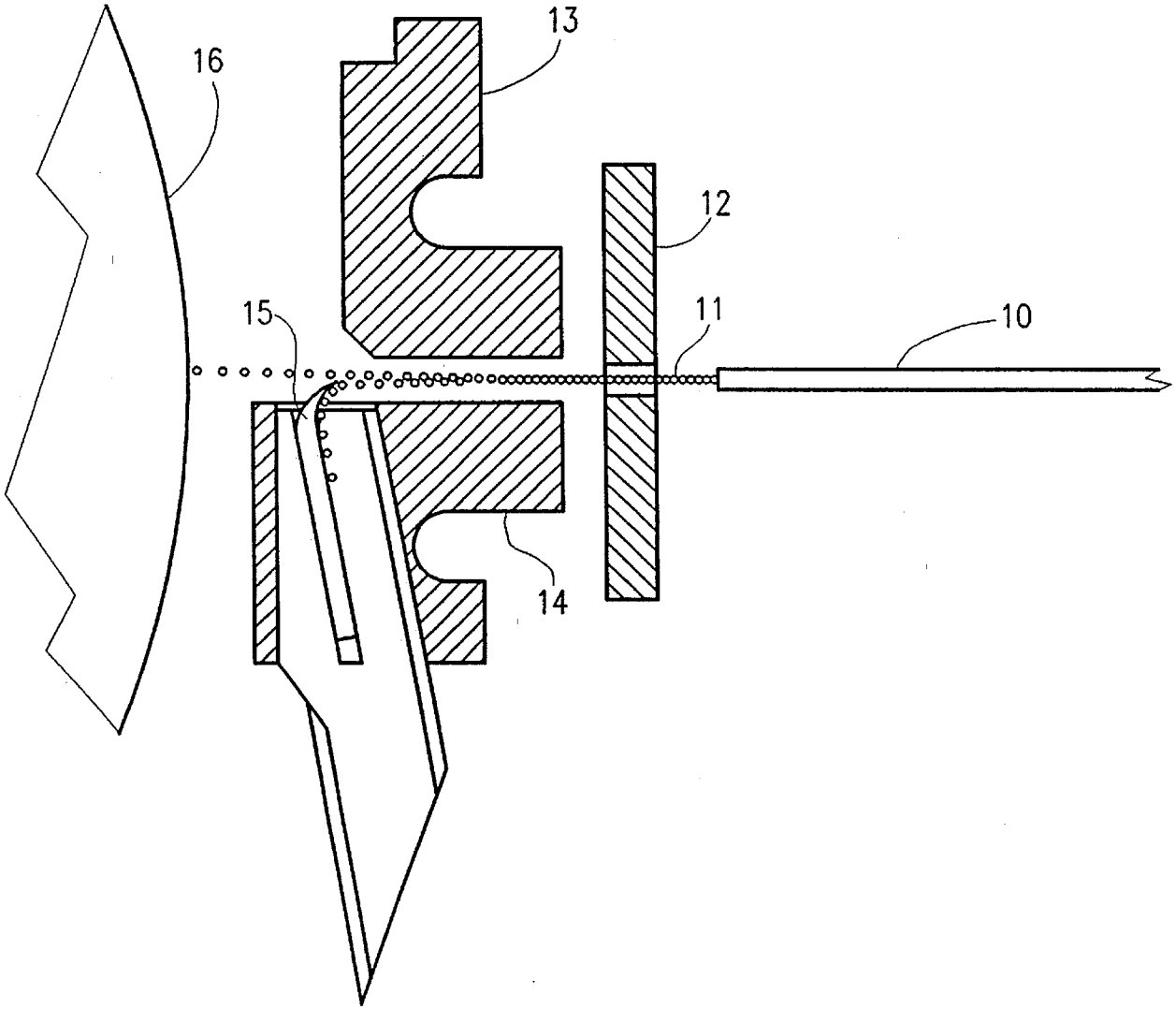
10
11
12
13
14
15
16

DEFLECTION ELECTRODE

This is a continuation of application Ser. No. 08/134,521 filed on Oct. 8, 1993, now abandoned.

FIELD OF THE INVENTION

The present invention relates to continuous ink jet printing and more particularly to deflection electrodes useful therein and methods of producing same.

BACKGROUND OF THE INVENTION

In continuous ink jet printing, a conductive, preferably aqueous based fluid is forced through a restriction at a relatively high pressure, creating a fine stream of liquid which is then broken into droplets. The resulting stream of droplets is selectably electrically charged and subsequently selectably deflected by a deflection electrode, so as to direct the droplet either to a target on a substrate to be marked or to a droplet collector.

In the prior art there are known porous deflection electrodes formed of vitreous carbon or stainless steel which allow any fluid to wick into the electrode for removal later in a printing cycle by vacuum. Such electrodes are quite brittle and have a relatively low production yield.

Deflection electrodes formed of sintered steel which is post treated at high temperatures are also known but suffer from non-uniform porosity.

The following U.S. Patents describe various electrode configurations useful in fluid jet printing: U.S. Pat. Nos. 4,307,407; 4,651,163; 4,658,269 and 4,839,664.

SUMMARY OF THE INVENTION

The present invention seeks to provide a deflection electrode for use in a continuous ink jet printing device and a method of manufacturing such a deflection electrode which overcome limitations and deficiencies of the prior art.

There is thus provided in accordance with a preferred embodiment of the present invention a deflection electrode for use in a continuous ink jet printing device molded of powdered ultra high molecular weight polyethylene combined with carbon black and subjected to oxygen plasma treatment.

Additionally in accordance with a preferred embodiment of the present invention, there is provided a method for manufacture of a deflection electrode including the steps of:

combining powdered ultra high molecular weight polyethylene with carbon black;

molding the electrode; and carrying out oxygen plasma treatment to produce a wettable surface on the molded electrode.

Preferably the proportion of carbon black to polyethylene is less than 5% by weight and more preferably between 0.25% and 2.0% by weight.

The oxygen plasma treatment may be performed either prior or subsequent to molding. Preferably, oxygen plasma treatment is performed subsequent to molding.

Additionally in accordance with a preferred embodiment of the present invention there is provided a deflection electrode for use in a continuous ink jet printing device, the deflection electrode being molded of polyethylene and carbon black and having a surface which is wettable by aqueous liquids.

BRIEF DESCRIPTION OF THE DRAWINGS

The present invention will be understood and appreciated more fully from the following detailed description, taken in conjunction with the sole FIGURE of the drawing which is a simplified illustration of an ink jet device including a typical deflection electrode.

DETAILED DESCRIPTION OF A PREFERRED EMBODIMENT

Referring now to FIG. 1, there is seen part of a typical continuous ink jet printing device including a droplet generator indicated generally by reference numeral 10, producing a stream of droplets 11. A charge tunnel 12 selectably charges some or all of the droplets. A pair of deflection electrodes, indicated respectively by reference numerals 13 and 14, selectably deflects some of the droplets 11 into collection engagement with a knife edge 15 and permits the undeflected droplets to impinge upon a substrate 16.

The present invention relates to the manufacture of the deflection electrode. In accordance with a preferred embodiment of the present invention a plastic material, preferably ultra high molecular weight polyethylene (UHMWPE), manufactured via the Ziegler process and commercially available under the trade name Microthene from Quantum Chemical Corp. of Cincinnati, Ohio or from other suppliers, is employed to manufacture the deflection electrode. The UHMWPE or other suitable material preferably has a molecular weight of several million, causing melt flow thereof to be very slight.

In accordance with the present invention, the limited melt flow characteristic of the plastic material is employed in accordance with the present invention in a step where mold cavities defining desired shapes of deflection electrodes are filled with fine pellets of the plastic material and heated to provide fusing of the beads at their respective contact points but virtually no melt flow which could block liquid passages defined by pores in the electrodes. Such a technique is employed in accordance with a preferred embodiment of the present invention to produce a material of predetermined void volume and pore size by the selection of pellets of particular size, and application of appropriate pressure and heat.

Further in accordance with a preferred embodiment of the present invention, carbon black is mixed in with the pellets of the above-described plastic material prior to molding so as to provide a uniform blend of a conductive polymer, which has conductive paths defined along carbon black chains thus formed therein. The molded product has a generally uniform surface with electrical conductive properties.

Inasmuch as UHMWPE is not wettable by aqueous inks, in accordance with a preferred embodiment of the present invention, the molded article is treated with an oxygen plasma to cause a chemical reaction to take place at exposed surfaces of the molded article. This chemical reaction, more specifically ionic oxygen bombardment, causes polar carbonyl bonds to be formed, producing carboxylic acid, ethers and ester groups to be permanently located on the surface of the molded article. The presence of such groups imparts a degree of polarity to the surface of the article and allows wetting thereof by aqueous fluids, thus creating a permanently wettable deflection electrode.

EXAMPLE I

A series of blends of UHMWPE and carbon black ranging from 0.5% to 2% by weight of carbon black were molded into deflection structures. Particles of diameter between 30–40 microns were employed with 1% carbon black and 0.5% carbon black. Particles of diameter 60 microns were employed with 1% carbon black. Molding was carried out at 110–120 degrees Centigrade for approximately 30 minutes in a compressed mold cavity. Each unit was treated with an oxygen plasma using conventional oxygen plasma treatment equipment which is commercially available from Advanced Surface Technologies, Bellerica, Mass. U.S.A. The resulting deflection electrodes exhibited excellent wicking of aqueous inks, i.e. excellent wetting, and provided an excellent electrical field when dry. The deflection electrodes thus produced were employed in an Iris 3024 printer, commercially available from Iris Graphics, Inc. of Six Crosby drive, Bedford Mass. 07130 U.S.A., with satisfactory results.

EXAMPLE II

Blends of 1% carbon black by weight in UHMWPE were molded into shapes having sharp edges and thin sections. The minimum radius of the sharp edges was 0.005 inch and the thinnest wall section was 0.051 inch. The molded structures were treated with an oxygen plasma similarly to that described in Example I. The resulting structures provided significant improvement in uniformity of porosity and wicking capabilities as compared to sintered stainless steel structures of similar configurations. When employed in an Iris 4012 printer, commercially available from Iris Graphics, Inc. of Six Crosby Drive, Bedford Mass. 07130 U.S.A., the observed uniform wicking capability and enhanced void volume provided a significant decrease in observed spitting and arcing and thus resulted in enhanced image quality over a relatively large number of sequential prints..pa It will be appreciated by persons skilled in the art that the present invention is not limited by what has been particularly shown and described hereinabove. Rather the scope of the present invention is defined only by the claims which follow:

We claim:

1. A deflection electrode for use in a continuous ink jet printing device, the deflection electrode comprising:

an electrode molded of powdered ultra high molecular weight polyethylene combined with carbon black in a proportion of carbon black to polyethylene of less than 1:1 by weight and treated with an oxygen plasma thereby to define a porous structure which has polar carbonyl bonds on the surface thereof and which thus exhibits wicking of aqueous inks.

2. A deflection electrode according to claim 1 and wherein the proportion of said carbon black to said polyethylene is less than 5% by weight.

3. A deflection electrode according to claim 1 and wherein the proportion of said carbon black to said polyethylene is between 0.25% and 2.0% by weight.

4. A deflection electrode for use in a continuous ink jet printing device, the deflection electrode comprising:

an electrode molded of polyethylene and carbon black in a proportion of carbon black to polyethylene of less than 1:1 by weight and having a porous surface having polar carbonyl bonds formed thereon and which is wettable by aqueous liquids.

5. A deflection electrode according to claim 4 and wherein the proportion of said carbon black to said polyethylene is less than 5% by weight.

6. A deflection electrode according to claim 4 and wherein the proportion of said carbon black to said polyethylene is between 0.25% and 2.0% by weight.

7. An electrode for use in a continuous ink jet printing device, the electrode comprising:

a molded plastic deflection electrode having a porous surface having polar carbonyl bonds formed thereon and which is permanently wettable by aqueous liquids, the polar carbonyl bonds being provided by at least one selected from the group consisting of carboxylic acid, ether and ester groups.

8. An ink jet printing device comprising:

a source of aqueous ink drops; and a deflection electrode for deflection of said ink drops, the deflection electrode being molded of polyethylene and carbon black in a proportion of carbon black to polyethylene of less than 1:1 by weight and having a surface having formed thereon polar carbonyl bonds, whereby the aqueous ink drops are provided to the deflection electrode and are deflected thereby for printing.

9. An ink jet printing device according to claim 8 and wherein the proportion of said carbon black to said polyethylene is less than 5% by weight.

10. An ink jet printing device according to claim 8 and wherein the proportion of said carbon black to said polyethylene is between 0.25% and 2.0% by weight.

11. An ink jet printing device comprising:

a source of ink drops; and a deflection electrode for deflection of said ink drops, the deflection electrode being molded of powdered ultra high molecular weight polyethylene combined with carbon black in a proportion of carbon black to polyethylene of less than 1:1 by weight and having a surface having formed thereon polar carbonyl bonds, whereby the aqueous ink drops are provided to the deflection electrode and are deflected thereby for printing.

12. An ink jet printing device according to claim 11 and wherein the proportion of said carbon black to said polyethylene is less than 5% by weight.

13. An ink jet printing device according to claim 11 and wherein the proportion of said carbon black to said polyethylene is between 0.25% and 2.0% by weight.

14. An ink jet printing device comprising:

a source of ink drops; and a molded plastic deflection electrode, the deflection electrode having a surface having formed thereon polar carbonyl bonds and which is permanently wettable by aqueous liquids, the polar carbonyl bonds being provided by at least one selected from the group consisting of carboxylic acid, ether and ester groups, whereby the aqueous ink drops are provided to the deflection electrode and are deflected thereby for printing.

15. A deflection electrode for use in an ink jet printing device which is manufactured according to the following method:

combining powdered ultra high molecular weight polyethylene with carbon black;

molding the electrode from a material comprising the combined polyethylene and carbon black; and carrying out oxygen plasma treatment to produce a surface on the molded electrode, which surface has formed thereon polar carbonyl bonds.

* * * * *